US005120601A

United States Patent [19]

Kotaki et al.

[11] Patent Number: 5,120,601

[45] Date of Patent: Jun. 9, 1992

[54] RECORDING MEDIUM AND A METHOD FOR THE INK-JET RECORDING USING THE SAME

[75] Inventors: Yasuo Kotaki, Kawasaki; Takahiro Mori, Yokohama; Masahiko Higuma, Tokyo; Hiroshi Sato, Yokohama, all of Japan

[73] Assignee: Canon Kabushiki Kaisha, Tokyo, Japan

[21] Appl. No.: 375,475

[22] Filed: Jul. 5, 1989

[30] Foreign Application Priority Data

Jul. 5, 1988 [JP] Japan ..... 63-168178
Nov. 25, 1988 [JP] Japan ..... 63-299074
Jun. 30, 1989 [JP] Japan ..... 1-169424

[51] Int. Cl.[5] ..... B41M 5/00

[52] U.S. Cl. ..... 428/327; 346/135.1; 428/195; 428/206; 428/335; 428/336

[58] Field of Search ..... 428/195, 500, 327, 335 428/336, 206; 346/135.1

[56] References Cited

FOREIGN PATENT DOCUMENTS 0191645 8/1986 European Pat. Off. .
0272125 6/1988 European Pat. Off. .

*Primary Examiner*—Pamela R. Schwartz
*Attorney, Agent, or Firm*—Fitzpatrick, Cella, Harper & Scinto

[57] ABSTRACT

A recording medium comprising a substrate and an ink-receiving layer containing highly water-absorptive resin particles and a binder thereon, wherein resin particles protruding to a height of not less than 1 μm from the surface of a binder layer of said ink-receiving layer are present in the number of from 50 to 5,000 per 1 mm of an ink-receiving surface, is provided.

55 Claims, No Drawings

RECORDING MEDIUM AND A METHOD FOR THE INK-JET RECORDING USING THE SAME

BACKGROUND OF THE INVENTION

1. Field of the Invention

The present invention relates to a recording medium suitably used in ink-jet recording. It also relates to a recording medium that can achieve a superior ink receptivity and recorded-image sharpness, and may cause beading and bleeding with difficulty.

The present invention further relates to a recording medium and a method for ink-jet recording using the same that can achieve a superior ink receptivity and recorded-image sharpness and may cause beading and bleeding with difficulty, even when ink is applied in a large quantity per unit area as in instances in which full color images are formed at a high density.

The beading mentioned in the present invention refers to a phenomenon in which dots irregularly move in the plane direction of the surface of an ink-receiving layer when ink is still fluid, before it is fixed in the ink-receiving layer, thus forming new aggregates together with adjacent dots to cause an unevenness in the density of recorded images.

The bleeding also refers to a phenomenon that edges of boundaries of multi-color printed areas can not be resolved because of feathering caused when ink is still fluid before it is fixed in the ink-receiving layer.

2. Related Background Art

Ink-jet recording has attracted notice as a recording method that makes less noise and can perform high-speed printing and multi-color printing. Hitherto having been used as recording media used in this ink-jet recording are papers commonly available, recording media called ink-jet recording papers, comprising a substrate provided with a porous ink-receiving layer, and light-transmissive recording media for OHP (overhead projectors).

In recent years, with improvement in the performance of ink-jet recording, such that the recording is performed at a higher speed and in more multi-colors, the recording media are simultaneous and increasingly required to have higher and more extensive properties.

In particular, it is necessary for the light-transmissive recording media to satisfy the fundamental requirements that;

1) they have excellent light-transmission properties;
2) they have excellent ink absorptivity;
3) dots are substantially round in shape, and have smooth peripheries;
4) dots have a high OD (optical density) and are free from blurs on the dot peripheries;
5) no beading is caused; etc.

In particular, the beading and bleeding are remarkably seen when a large quantity of ink is simultaneously shot on a recording medium as in instances in which a recording head having a plurality of ink ejection orifice (nozzles) is used, or instances in which full color images are formed using multi-color inks.

In ink-jet recording techniques, the beading that may lower the image quality level and slow the ink-fixing rate is coming to be a matter of a great account as recording is performed at a higher speed and in more colors using a multi-nozzle. The bleeding that may bring about a lowering of the resolution of images has also come to be a matter of a great account as nozzle: are used in a higher multiplicity.

Various studies have been made so as to satisfy the above performances, and the result has been obtained tc a certain extent. However, in the present circumstances no recording medium has been known that has satisfiec all of these required performances.

For example, a recording medium for ink-jet record ing which comprises a substrate provided with a cove containing a water-absorptive resin is disclosed in Japa nese Patent Laid-Open Gazette No. 57-173194. In thi medium, a polymeric binder used in combination wit the water-absorptive resin is used in an amount of fron 0.05 to 5 parts by weight based on 1 part by weight o the water-absorptive resin, and coated with a weight o approximately from 1 g/m$^2$ to 50 g/m$^2$ in terms of solic content. However, this covering layer has, as a result 5,000 or more of the number of the water-absorptiv resin particles in a unit area of 1 mm$^2$, resulting in lowering of light-transmission properties and causing high haze. This is not desirable for the transmitted-ligh viewing in slide projectors, OHP or the like.

Japanese Patent Laid-Open Gazette No. 61-2449 also discloses an OHP film comprising a transparen film coated thereon with fine particles having transpar ency. This, however, comprises the fine particles with laminated structure, and hence has the disadvantag that it causes a high haze.

For further examples, Japanese Patent Laid-Ope Gazette No. 60-46290 discloses an OHP film formed o a coating comprising a highly water-absorptive poly mer and a water-insoluble binder, and Japanese Paten Laid-Open Gazette No. 63-151477 discloses an OH film comprising a highly water-absorptive resin and solvent-soluble resin which are used in combination.

Even such recording media, however, can not simul taneously satisfy the requirements of ink fixability an prevention of occurrence of a beading and bleedin when the ink has been applied in a high density and large quantity.

SUMMARY OF THE INVENTION

Accordingly, an object of the present invention is t provide a recording medium and a method for the ink jet recording using the same that has, in particular, superior ink receptivity and a superior sharpness c recorded images and may not cause the beading.

Another object of the present invention is to provid a recording medium and a method for the ink-jet re cording using the same that has a high ink receptivity, free from sticking at printed areas, has excellent sharp ness of recorded images and may not cause a beadin and a bleeding even when inks have been applied in high density.

A further object of the present invention is to obtai a recording medium that can obtain highly transparer and highly detailed images even in instances in whic recorded images are projected through an optical ir strument.

The present invention provides a recording mediu comprising a substrate and an ink-receiving layer cor taining highly water-absorptive resin particles and binder thereon, wherein resin particles protruding to height of not less than 1 μm from the surface of a binde layer of said ink-receiving layer are present in the num ber of from 50 to 5,000 per 1 mm$^2$ of an ink-receivin surface.

In another embodiment, the present invention provides a recording medium comprising a substrate and an ink-receiving layer containing highly water-absorptive resin particles and a binder thereon, wherein said ink-receiving layer contains the binder in an amount of from 16 to 100 parts by weight based on 1 part by weight of resin particles having an average particle diameter of from 10 to 30 μm, and resin particles protruding to a height of not less than 1 μm from the surface of a binder layer of said ink-receiving layer are present in the number of from 50 to 5,000 per 1 $mm^2$ of an ink-receiving surface.

In still another embodiment, the present invention provides a recording medium comprising a substrate and an ink-receiving layer containing highly water-absorptive resin particles and a binder thereon, wherein resin particles protruding to a height of not less than 1 μm from the surface of a binder layer of said ink-receiving layer are present in a number of from 50 to 5,000 per 1 $mm^2$ of an ink-receiving surface, and said binder layer contains a gelling agent.

In further embodiment, the present invention provides a method for the ink-jet recording, in which a recording is carried out by applying ink-droplets on a recording medium, which recording medium comprising an ink-receiving layer containing highly water-absorptive resin particles and a binder, said resin particles protruding to a height of not less than 1 μm from the surface of a binder layer of said ink-receiving layer being present in the number of from 50 to 5,000 per 1 $mm^2$ of an ink-receiving surface, and maximum applied ink quantities being of from 5 to 10 nl per 1 $mm^2$ of an ink-receiving surface.

In other further embodiment, the present invention provides a method for the color ink-jet recording, in which a recording is carried out by applying ink-droplets of different color on a recording medium, which recording medium comprises an ink-receiving layer containing highly water-absorptive resin particles and a binder, said resin particles protruding to a height of not less than 1 μm from the surface of a binder layer of said ink-receiving layer being present in the number of from 50 to 5,000 per 1 $mm^2$ of an ink-receiving surface, and maximum applied ink quantities of each color being of from 5 to 10 nl per 1 $mm^2$ of an ink-receiving surface.

DETAILED DESCRIPTION OF THE PREFERRED EMBODIMENTS

The recording medium of the present invention comprises a substrate and an ink-receiving layer. The ink-receiving layer is mainly constituted of highly water-absorptive resin particles and a binder.

As the substrate used in the present invention, any substrates can be used so long as they are light-transmissive. They include, for example, films or sheets made of a polyester resin, a diacetate resin, a triacetate resin, an acrylic resin, a polycarbonate resin, a polyvinyl chloride resin or a polyimide resin, and glass sheets.

Next, the highly water-absorptive resin particles used in the ink-receiving layer according to the present invention are resin particles having a water-absorbing power of from 50 to 1,000 times their own weight. They specifically include, as disclosed in Japanese Patent Laid-Open Gazette Nos. 57-173194 and 58-24492, sodium polyacrylate, lithium polyacrylate, potassium polyacrylate, a vinyl alcohol/acrylamide copolymer, a sodium acrylate/acrylamide copolymer, cellulose (carboxymethyl compound or graft polymer) polymers, starch (hydrolysate of acrylonitrile graft compound, or grafted acrylate) polymers, an isobutylene/maleic anhydride copolymer, a vinyl alcohol/acrylic acid copolymer, and polyethylene oxide modified products, dimethyl ammonium polydiallylate, quaternary ammonium polyacrylate.

Such particles have an average particle diameter of from 1 to 100 μm, preferably from 5 to 50 μm, and more preferably from 10 to 30 μm, which range is desirable from the viewpoints of smooth feeling of a low-haze surface of the ink-receiving layer, uniform and swift ink absorption rate, uniform resolution, and so forth.

The binder used in the present invention may be comprised of any materials so long as they are materials capable of absorbing water-based inks and fixing dyes contained in ink. It, however, is required to be comprised of at least a hydrophilic resin because the ink is water-based.

Such a hydrophilic resin includes, for example, natural resins such as albumin, gelatin, casein, starch, cationic starch, gum arabic, and sodium alginate; synthetic resins such as carboxymethyl cellulose, hydroxyethyl cellulose, ion-modified hydroxyethyl cellulose, polyamide, polyacrylamide, polyethyleneimine, polyvinyl pyrrolidone, quaternized polyvinyl pyrrolidone, polyvinyl pyridinium halide, melamin resin, phenol resin, alkyd resin, polyurethane, polyvinyl alcohol, ion-modified polyvinyl alcohol, polyester, sodium polyacrylate, polyethylene oxide, poly-2-hydroxyethyl methacrylate, or hydrophilic polymers made water-insoluble by cross-linking of these polymers; hydrophilic and water-soluble polymer complexes comprising two or more kinds of polymers; and hydrophilic and water-soluble polymers having a hydrophilic segment.

The hydrophilic resins as described above may preferably be organic solvent soluble resins. If such hydrophilic resins are not the organic solvent soluble resins but water-soluble resins, it follows that the highly water-absorptive resin particles are mixed in an aqueous system with the hydrophilic resin which is insoluble to organic solvents, resulting in a high viscosity to make it difficult to carry out coating. In such an instance, however, the mixture may be diluted with water to enable the coating.

The ink-receiving layer in the present invention, in which the main materials as described above are used, comprises highly water-absorptive resin particles protruding to a height of not less than 1 μm, preferably 1 to 100 μm, more preferably 1 to 30 μm from the surface of a binder layer, such particles being present in the number of from 50 to 5,000 per 1 $mm^2$ of an ink-receiving surface. Taking such a structure makes it possible to obtain a recording medium that has a superior ink receptivity and a superior sharpness of recorded images and yet may cause neither beading nor bleeding.

A height less than 1 μm, of the above particles protruding from the surface of the binder layer results in excessively small surface areas of the protruding highly water-absorptive resin particles, making it impossible to exhibiting the effect of preventing the beading. On the other hand, a height more than 100 μm, of the above particles results in excessively small particle-fixed areas in the binder layer, so that the adhesion of particles is lowered to cause powder fall, which means that resin particles peel off and fall from an ink-receiving surface.

A number less than 50, of the particles per 1 $mm^2$ may result in an insufficiency in the effect of preventing the beading, making it impossible to suppress the sticking or blocking on the surface as in the case of conventional recording media provided with a non-porous ink-receiving layer. On the other hand, a number more than 5,000, of the particles may result in a high haze to lower the light-transmission properties, making it impossible to obtain highly detailed images.

In a more preferred embodiment of the present invention, the particles protrude from the binder layer in a height of from 1 to 30 μm, and such particles are present in the number of from 50 to 1,000 per 1 $mm^2$ of the ink-receiving surface.

It is necessary for forming such an ink-receiving layer to use, when, for example, particles with a particle diameter of from 10 to 30 μm are used as the highly water-absorptive resin particles, the binder in an amount of from 16 to 100 parts by weight based on 1 part by weight of resin particles, preferably from 16 to 80 parts by weight, and more preferably from 16 to 50 parts by weight, and also carry out coating so that the thickness of the binder layer formed on the substrate may range from 1 to 100 μm, preferably from 1 to 50 μm, and more preferably from 2 to 30 μm, in dried thickness.

In the present invention, a gelling agent may preferably be contained in the binder for the purpose of further improving the ink receptivity and the blocking resistance exhibited when an ink is adhered in a high density and a large quantity.

The gelling agent mentioned in the present invention refers to a compound capable of lowering the fluidity of water, alcohols, polyhydric alcohols and organic solvents contained in inks and solidifying them.

In general, the mechanism of gelation is presumed that networks of compounds are constructed by hydrogen bonds produced between hydroxyl groups and amino groups of a gelling agent, and a desired solvent is confined between the networks.

The gelling agent used in the present invention includes sorbitol derivatives as typified by a condensation product of sorbitol with benzaldehyde, isocyanate compounds, gelling agents of an amino acid type as typified by N-lauroyl-L-glutamic acid-α, γ-di-n-butylamide, agar, calaguinan, pectin, and geran gum.

In particular, in the ink-jet recording in which a water-based ink is used by preference, suited as the gelling agent is a condensation product of sorbitol with an aromatic aldehyde, which has an excellent gelling ability for water, alcohols and polyhydric alcohols contained in inks and is chemically stable to the moisture in the air.

As the sorbitol, D-sorbitols are readily utilizable because D-types are available with ease.

The aromatic aldehyde includes benzaldehyde, halogenated benzaldehyde, tolualdehyde, salicylaldehyde, cinnamaldehyde, and naphthaldehyde. The condensation products of sorbitol with these compounds are used alone or in combination of plural kinds.

In particular, a condensation product of D-sorbitol with benzaldehyde, which is available with ease and also has a high gelation effect, is most preferred.

The condensation product of D-sorbitol with benzaldehyde, used in the present invention, is synthesized by condensation reaction of D-sorbitol with benzaldehyde, and it is possible to synthesize condensation products comprising D-sorbitol and benzaldehyde in molar ratios of 1:1, 1:2 and 1:3. It is preferred to use the product of the molar ratio of 1:2 or 1:3, and most preferred to use the product of the molar ratio of 1:2.

Of the condensation products of D-sorbitol with benzaldehyde, the product of the molar ratio of 1:2 is called dibenzylidene sorbitol (trade name: Gelall D available from Shin-Nippon Chemical Industries, Co. Ltd.) and the product of the molar ratio of 1:3 is called tribenzylidene sorbitol (trade name: Gelall T; available from Shin-Nippon Chemical Industries, Co., Ltd.).

The dibenzylidene sorbitol is a chemically neutral compound, which shows solubility (about 20% by weight) to solvents such as N-methylpyrrolidone, N,N dimethylformamide, and dimethyl sulfoxide. It, however, has a small solubility to most solvents as exemplified by ethyl alcohol, isopropyl alcohol, ethylene glycol, glycerol, diethylene glycol, benzyl alcohol, ethy cellosolve, tetrahydrofuran, dioxane, cyclohexylamine aniline, and pyridine, and has the property that a solution thereof is gelled upon cooling after dissolution by heating. In the present invention, the fixing of a recording solution is attained by utilizing this gelation powe (the ability of gelling or solidifying a liquid) to suppres the fluidity of a low-volatile solvent such as polyhydric alcohols contained in the recording solution used when the ink-jet recording is performed.

The gelling agent may preferably be contained in the binder in an amount of from 30% to 70% by weight. An amount less than 30% by weight, of the gelling agen contained in the binder may result in a small gelation effect, making it impossible to improve the ink receptivity exhibited when ink is adhered in a large quantity. On the other hand, an amount more than 70% by weight, of such a gelling agent may result in a poorness in th affinity of the binder for the ink, making it difficult fo the ink to permeate into the binder, and worsen th ink-fixing performance.

In the present invention, resins such as SBR latex NBR latex, polyvinyl formal, polymethyl methacrylate polyvinyl butyral, polyacrylonitrile, polyvinyl chloride polyvinyl acetate, phenol resin, and alkyd resin may b optionally used in combination, for the purpose of reinforcing the ink-receiving layer and/or improving adhesion between it and the substrate.

For the purpose of enhancing the ink absorptivity of the ink-receiving layer, it is also possible to disperse filler of every type in the ink-receiving layer to th extent that the light-transmission properties may not b impaired, which filler is as exemplified by silica, clay talc, diatomaceous earth, calcium carbonate, calcium sulfate, barium sulfate, aluminum silicate, synthesize zeolite, alumina, zinc oxide, lithopone, and satin whit It is also effective to incorporate a surface activ agent of an anionic type, a nonionic type or a cationic type in the ink-receiving layer so that the dot diameter used when recording is performed can be controlled the ink absorption rate can be accelerated, or the sticking of printed areas can be much better prevented.

The recording medium of the present invention ca be formed using the main materials as described abov In a preferred embodiment, however, both the substrate and ink-receiving layer have light-transmission properties and have a haze of not more than 50 % so that th recording medium as a whole has light-transmissic properties.

The recording medium of this embodiment, which superior particularly in the light-transmission properties, is mainly used in the instance of OHP or the like, which recorded images are projected on a screen or th like by use of an optical instrument.

Such a light-transmissive recording medium can be prepared by forming on the light-transmissive support as described above a light-transmissive ink-receiving layer comprising at least the above binder and highly water-absorptive resin particles.

As methods of forming such an ink-receiving layer, preferred is a method in which a coating solution is prepared by dissolving or dispersing the above binder and highly water-absorptive resin particles, or a mixture thereof with other polymers or additives, in a suitable solvent and the resulting coating solution is applied on the light-transmissive support by a known method as exemplified by roll coating, rod bar coating, spray coating or air-knife coating, followed immediately by drying.

The recording medium with the embodiment formed in the above way is a light-transmissive recording medium having sufficient light-transmission properties.

The sufficient light-transmission properties mentioned in the present invention is meant for the recording medium to have a haze of not more than 50%, and preferably not more than 20%.

The haze which is not more than 50% makes it possible to view recorded images by projecting them on a screen.

In the present invention, the recording media with various embodiments as described above may further comprise organic or inorganic fine particles applied on the recording surfaces thereof in a proportion of about 0.01 to about 1.0 g/m$^2$. This enables further improvements in the carrying performance of the resulting recording media in a printer, the blocking resistance required when they are laid overlapping, the fingerprint resistance, and so forth.

Typical embodiments of the recording medium of the present invention have been exemplified above to describe the present invention. As a matter of course, however, the recording medium of the present invention is by no means limited to these embodiments. In any embodiments, the ink-receiving layer may contain all sorts of known additives such as dispersants, fluorescent dyes, pH adjusters, antifoaming agents, lubricants and antiseptics.

The recording medium of the present invention may not necessarily be colorless, and may include colored recording media.

In case of forming an image by the method for ink-jet recording of the present invention, the ink is preferably applied with a quantity of at most 5-30 nl per 1 mm$^2$ of the ink-receiving surface, in view of image density and image quality. In a case that, for example, a color image is formed using four color inks of black, magenta, cyan and yellow, a color image of an excellent sharpness, a high optical density and no bleeding and beading can be obtained by applying each ink with a quantity of at most 5-10 nl per 1 mm$^2$.

An applied quantity of each ink less than 5 nl per 1 mm$^2$ may result in an insufficiency in the image density, the image sharpness and the contrast, although a problem of a bleeding or beading may not be caused. On the other hand, an applied quantity of each ink more than 10 nl per 1 mm$^2$ may cause easily a bleeding or beading, although a high density image can be obtained.

Because high speed printing is possible in bubble-jet printing to eject an ink from an orifice by applying heat energy to inks, it is preferable to use a bubble-jet process in the present invention.

The recording medium of the present invention as described above has a superior ink receptivity and can give recorded images with a superior sharpness. It is therefore possible in the recording of not only monochromatic images but also full-colored images to obtain recorded images free from any phenomenon in which an ink flows out or exudes, and also causing neither beading nor bleeding, even when inks with different colors are adhered overlapping in a short time and at the same area.

In the present invention, it is also possible to provide recording media having excellent surface gloss that has not been seen in the conventional ink-jet recording media. It is further possible to apply them in other uses than the conventional use in which surface images are viewed, which other uses are exemplified by media used in viewing recorded images by projecting them on a screen or the like using an optical instrument such as a slide projector or OHP, color separation plates used when positive plates for color printing are prepared, or CMF used in color display such as liquid crystal display.

EXAMPLES

The present invention will be described below in greater detail by giving Examples. In the following, "part(s)" or "%" is by weight unless particularly mentioned.

EXAMPLE 1

A methanol solution of 10% polyethylene oxide (R-1000, available from Meisei Chemical Works, Ltd.) is herein designated as "a". Next, as the highly water-absorptive resin particles, a crosslinked product of an acrylic acid/vinyl alcohol copolymer (Sumicagel SP-510, available from Sumitomo Chemical Co., Ltd.; average particle diameter: 10 to 20 μm) is designated as "b".

A polyethylene terephthalate film (available from Toray Industries, Inc.) of 100 μm thick was used as the light-transmissive support. Using a bar coater, this film was coated thereon with a coating solution obtained by mixing the above materials in a ratio of a:b=35:1 as solid contents, so as to have a thickness of 6 μm after dried, followed by drying under conditions of 80° C. for 5 minutes, thus obtaining a light-transmissive recording medium of the present invention.

EXAMPLE 2

Example 1 was repeated but changing the ratio in Example 1 to a:b=16:1, thus obtaining a 5 recording medium.

EXAMPLE 3

Example 1 was repeated but changing the ratio in Example 1 to a:b=25:1, thus obtaining a recording medium.

EXAMPLE 4

Example 1 was repeated but changing the ratio in Example 1 to a:b=40 : 1, thus obtaining a recording medium.

EXAMPLE 5

Example 1 was repeated but changing the ratio in Example 1 to a:b=25:1 and the thickness after dried, to 3 μm, thus obtaining a recording medium.

EXAMPLE 6

Example 1 was repeated but changing the ratio in Example 1 to a:b=25:1 and the thickness after dried, to 10 μm, thus obtaining a recording medium.

EXAMPLE 7

Example 1 was repeated but changing the ratio in Example 1 to a:b=80:1, thus obtaining a recording medium.

COMPARATIVE EXAMPLE 1

Example 1 was repeated but changing the ratio in Example 1 to a:b=1:1, thus obtaining a recording medium.

COMPARATIVE EXAMPLE 2

Example 1 was repeated but changing the ratio in Example 1 to a:b=300:1, thus obtaining a recording medium.

Using four kinds of inks of yellow, cyan, magenta and black, ink-jet recordings were carried out on each recording medium of the above Examples and Comparative Examples with use of a recording apparatus comprising a bubble jet recording head, in which inks are bubbled into air ink droplets by applying heat energy to inks and ejected from an orifice (droplet volume: 24 pl; image density: 16 pel; maximum applied quantity of each ink: 6.0 nl/mm$^2$; maximum number of color overlapping: 3; maximum quantity of inks on the recording medium: 18.0 nl/mm$^2$; ejection frequency: 2 kHz).

REFERENCE EXAMPLE 1

Using a recording medium of Comparative Example 2, a recording was carried out. The bubble jet recording head was cooled so as to be adjusted to a maximum applied quantity of from 6.0 nl/mm$^2$ to 4.2 nl/mm$^2$.

The height of the protruded particles of the recording medium in each Example and Comparative Example, the number N of the particles per 1 mm$^2$, and the results of evaluation are shown in Tables 1 and 2.

The measurement for each evaluation item in Tables 1 and 2 was made according to the following manner.

(1) The height of protruded particles and the number of the particles per 1 mm$^2$ were measured using a three-dimensional surface roughness measuring device (SE.3FK, available from Kosaka Kenkyusho K.K.; detector tip diameter R: 2.0 μm; load: 30 mg). In the measurement, the highly water-absorptive resin particles that protrude less than 1 μm from the binder layer are not included in the number N. Thus, the height and number of only the particles that are recognized to protrude not less than 1 μm from the binder layer are measured.

(2) As the ink-fixing time, measured was the time for which a recording medium having been applied with solid prints using a black ink was left to stand at room temperature (20° C., 65% RH) until the ink dried and turned not to adhere to fingers when recorded images were touched.

(3) The haze was measured using a direct-reading haze meter (available from Toyo Seiki Seisakusho) having an optical system based on JIS K 6714.

(4) The beading was visually judged on two color solid-printed areas. A product in which no beading occurred was evaluated as A; a product in which the beading significantly occurred, as E. Evaluation of five steps method (A to E) was adopted.

(5) The bleeding was visually judged on boundary edges of two color solid-printed areas. A product in which no bleeding occurred was evaluated as A; a product in which the bleeding occurred, as C; and a product intermediate between these, as B.

(6) As the image density, measured was the transmittance on solid areas using a black ink by means of a Macbeth TR-524 meter.

TABLE 1

| | Examples | | | | | | |
|---|---|---|---|---|---|---|---|
| | 1 | 2 | 3 | 4 | 5 | 6 | 7 |
| Number of protruded particles per 1 mm$^2$: | 350 | 750 | 490 | 300 | 450 | 350 | 150 |
| Ink-fixing time: (mm) | 0.5 | 0.5 | 1 | 1.5 | 1.5 | 0.5 | 1.5 |
| Haze (%): | 8.5 | 15 | 12 | 8.0 | 6.0 | 20.0 | 4.0 |
| Beading: | A | A | A | A | A | A | A |
| Bleeding: | A | A | A | A | A | A | A |
| Image density: | 0.46 | 0.46 | 0.47 | 0.46 | 0.44 | 0.46 | 0.46 |

TABLE 2

| | Comparative Examples | | Ref. Ex. |
|---|---|---|---|
| | 1 | 2 | 1 |
| Number of protruded particles per 1 mm$^2$: | 6,000 | 45 | 45 |
| Ink-fixing time (min): | 2 | ≧15 | 3 |
| Haze (%): | 80 | 3.0 | 3.0 |
| Beading: | A | D | B |
| Bleeding: | A | C | A |
| Image density: | 0.48 | 0.44 | 0.28 |

EXAMPLES 8 TO 12, COMPARATIVE EXAMPLES 3, 4, and REFERENCE EXAMPLE 2

Using the materials and with the composition a shown in Table 3, mixing, dispersing and dissolvin were carried out to prepare coating solutions. The coat ing solutions were applied using a bar coater on trans parent substrates, polyethylene terephthalate films o 100 μm thick (trade name: Lumilar T; available fron Toray Industries, Ltd.), under conditions that may giv a dried film thickness of 4 μm (at binder portions), fol lowed by drying under conditions of 140° C. for 3 min utes, thus obtaining light-transmissive recording medi ums according to Examples 8 to 12 of the present inven tion, Comparative Examples 3 and 4, and Referenc Example 2.

Using yellow, cyan, magenta and black inks with th following composition, ink-jet recordings were carrie out on the respective recording medium of the abov Examples, Comparative Examples and Reference Ex ample with use of a recording apparatus comprising bubble-jet recording head of a system in which inks are ejected by bubbling of inks (ejection droplet volume: 30 pl; image density: 16 pel; maximum applied quantity of each ink: 7.4 nl/mm$^2$; maximum number of color overlapping: 3; maximum quantity of inks on the recording medium: 22.2 nl/mm$^2$; ejection frequency: 2 kHz).

| Yellow ink: (Composition) | |
|---|---|
| C.I. Acid Yellow 23 | 3% by weight |
| Diethylene glycol | 30% by weight |
| Water | 67% by weight |
| Cyan ink: (Composition) | |
| C.I. Direct Blue 86 | 3% by weight |
| Diethylene glycol | 30% by weight |
| Water | 67% by weight |
| Magenta ink: (Composition) | |
| C.I. Acid Red 35 | 3% by weight |
| Diethylene glycol | 30% by weight |
| Water | 67% by weight |
| Black ink: (Composition) | |
| C.I. Direct Black 19 | 3% by weight |
| Diethylene glycol | 30% by weight |
| Water | 67% by weight |

Using the respective recording medium according to Examples 8 to 12, Comparative Examples 3 and 4 and Reference Example 1, measurements were made on each evaluation item in the same manner as in Example 1. Results obtained are shown in Table 3.

In regard to the ink-fixing time of evaluation item (2), however, the measurement was made on the following criterion.

As the ink-fixing time of (2), measured was the time for which a recording medium on which full dots of three colors of yellow, cyan and magenta have been recorded was left to stand at room temperature (20° C., 65% RH) until the ink dried and turned not to adhere to fingers when recorded images were touched.

And also a blocking resistance was additionally evaluated.

(7) The blocking resistance was evaluated as follows:

Full-dots of three colors of yellow, magenta and cyan were recorded on a recording medium, the recording medium was settled for 24 hours under conditions of 23° C. and 50% RH, then PET film (trade name: Lumilar T, 100 μm, available from Toray Industries, Ltd.) was laminated on the ink-receiving surface, and settled again for 24 hours under conditions of 35° C, 90% RH and a pressure of 10 g/m$^2$.

A product in which the ink-receiving layer and the PET film were easily peelable was evaluated as A, a product in which the ink-receiving layer and the PET film were not peelable, as C, a product in which a break of the ink-receiving layer occurred in case of peeling or a large force for peeling is required, as B.

TABLE 3

| Binder layer thickness, and materials and compositional proportion of recording medium: | Examples 8 | 9 | 10 | 11 | 12 | Ref. Ex. 2 | Comparative Examples 3 | 4 |
|---|---|---|---|---|---|---|---|---|
| Composition of coating solution (pbw): | | | | | | | | |
| Highly water-absorptive resin particles: Sumicagel SP-510 *1 | 5 | 5 | 4 | 5 | 2 | 5 | 60 | 0 |
| Resins in binder: PVP K-90 *2 | 40 | — | 30 | 70 | 40 | 100 | 40 | 40 |
| R-1000 *3 | — | 32 | — | — | — | — | — | — |
| Poly (2-HEMA) *4 | — | 8 | — | — | — | — | — | — |
| Gelling agent in binder: Gelall D *5 | 60 | 60 | 70 | 30 | 60 | — | 60 | 60 |
| Solvent: Dimethylformamide | 700 | 700 | 700 | 700 | 700 | 700 | 700 | 700 |
| Layer thickness of binder (μm): | 4 | 4 | 4 | 4 | 4 | 4 | 4 | 4 |
| Amount of gelling agent in binder (wt. %): | 60 | 60 | 70 | 30 | 60 | 0 | 60 | 60 |
| Number of protruded highly water-absorptive resin particles (number/mm$^2$): | 400 | 400 | 300 | 400 | 150 | 400 | 6,500 | 0 |
| Evaluation results: | | | | | | | | |
| Ink-fixing time (min): | 3 | 3 | 4 | 5 | 3 | ≧60 | 3 | 10 |
| Haze (%) | 10 | 11 | 8 | 11 | 6 | 9 | 60 | 3 |
| Beading: | A | A | A | A | A | B | A | E |
| Bleeding: | A | A | A | A | A | A | A | C |
| Blocking resistance | A | A | A | A | A | B | A | A |

*1 (available from Sumitomo Chemical Co., Ltd.) Average particle diameter: 10 to 20 μm; a cross-linked product of a polyvinyl alcohol/-polyacryloyl ester copolymer.
*2 (available from G.A.F. Corp.) Poly(N-vinyl-2-pyrrolidone); average molecular weight: 360,000.
*3 (available from Meisei Chemical Works, Ltd.) Polyethylene oxide.
*4 Poly(2-hydroxyethyl methacrylate); average molecular weight: 200,000.
*5 (available from Shin-nippon Chemical Industries Co., Ltd.) Condensation product of D-Sorbitol: benzaldehyde = 1:2.

According to the present invention, it is possible to obtain recording media that has a superior ink-fixing performance, in particular, against a large quantity of the ink, has high light-transmission properties and good blocking resistance can give highly detailed images, and may cause no beading and bleeding.

We claim:

1. A recording medium comprising a substrate and an in-receiving layer containing highly water-absorptive resin particles having an average diameter ranging from 1 to 100 μm and a binder thereon, wherein said binder comprises a hydrophilic resin, wherein said resin particles protrude to a height of not less than 1 μm from the surface of the binder of said ink-receiving layer and are present in the number of from 50 to 5,000 per 1 mm$^2$ of the ink-receiving surface, wherein the ink-receiving layer contains the binder in an amount of from 16 to 100 parts by weight based on 1 part by weight of resin particles, and wherein the recording medium has a haze of not more than 50%.

2. The recording medium according to claim 1, wherein said highly water-absorptive resin particles have a water-absorbing power of from 50 to 1,000 times their own weight.

3. The recording medium according to claim 1, wherein said highly water-absorptive resin particles comprise a material selected from the group consisting of sodium polyacrylate, lithium polyacrylate, potassium polyacrylate, a vinyl alcohol/acrylamide copolymer, a sodium acrylate/acrylamide copolymer, a cellulose polymer, a starch polymer, an isobutylene/maleic anhydride copolymer, a vinyl alcohol/acrylic acid copolymer, and a polyethylene oxide modified product. dimethyl ammonium polydiallylate, quaternary ammonium polyacrylate.

4. The recording medium according to claim 1, wherein said binder has a thickness of from 1 to 100 μm.

5. The recording medium according to claim 1, wherein said binder has a thickness of from 1 to 50 μm.

6. The recording medium according to claim 1, wherein said binder has a thickness of from 2 to 30 μm.

7. The recording medium according to claim 1, wherein said resin particles are present in the number of from 50 to 1,000 per 1 $mm^2$ of the ink-receiving surface.

8. The recording medium according to claim 1, wherein said recording medium is light-transmissive.

9. A recording medium comprising a substrate and an in-receiving layer containing highly water-absorptive resin particles and a binder thereon, wherein said binder comprises a hydrophilic resin, wherein said ink-receiving layer contains the binder in an amount of from 16 to 100 parts by weight based on 1 part by weight of resin particles having an average particle diameter of from 10 to 30 μm, wherein said resin particles protrude to a height of not less than 1 μm from the surface of the binder of said ink-receiving layer and are present in the number of from 50 to 5,000 per 1 $mm^2$ of the ink-receiving surface, and wherein the recording medium has a haze of not more than 50%.

10. The recording medium according to claim 9, wherein said highly water-absorptive resin particles have a water-absorbing power of from 50 to 1,000 times their own weight.

11. The recording medium according to claim 9, wherein said highly water-absorptive resin particles comprise a material selected from the group consisting of sodium polyacrylate, lithium polyacrylate. potassium polyacrylate, a vinyl alcohol/acrylamide copolymer, a sodium acrylate/acrylamide copolymer, a cellulose polymer, a starch polymer, an isobutylene/maleic anhydride copolymer, a vinyl alcohol/acrylic acid copolymer, and a polyethylene oxide modified product, dimethyl ammonium polydiallylate, quaternary ammonium polyacrylate.

12. The recording medium according to claim 9, wherein said binder has a thickness of from 1 to 100 μm.

13. The recording medium according to claim 9, wherein said binder has a thickness of from 1 to 50 μm.

14. The recording medium according to claim 9, wherein said binder has a thickness of from 2 to 30 μm.

15. The recording medium according to claim 9, wherein said resin particles are present in the number of from 50 to 1,000 per 1 $mm^2$ of the ink-receiving surface.

16. The recording medium according to claim 9, wherein said binder is contained in an amount of from 16 to 80 parts by weight based on 1 part by weight of said resin particles.

17. The recording medium according to claim 9, wherein said binder is contained in an amount of from 16 to 50 parts by weight based on 1 part by weight of said resin particles.

18. The recording medium according to claim 9, wherein said recording medium is light-transmissive.

19. A recording medium comprising a substrate of an ink-receiving layer containing highly water-absorptive resin particles having an average diameter ranging from 1 to 100 μm and a binder thereon, wherein said binder comprises a hydrophilic resin, wherein said resin particles protrude to a height of not less than 1 μm from the surface of the binder of said ink-receiving layer and are present in the number of from 50 to 5,000 per 1 $mm^2$ of the ink-receiving surface, and said binder contains a gelling agent, wherein the ink-receiving layer contains the binder in an amount of from 16 to 100 parts by weight based on 1 part by weight of resin particles, and wherein the recording medium has a haze of not more than 50%.

20. The recording medium according to claim 19, wherein said gelling agent comprises a condensation product of sorbitol with an aromatic aldehyde.

21. The recording medium according to claim 19, wherein said gelling agent is contained in an amount of from 30% to 70% by weight based on the total weight of said binder.

22. The recording medium according to claim 19, wherein said highly water-absorptive resin particles have a water-absorbing power of from 50 to 1,000 times their own weight.

23. The recording medium according to claim 19, wherein said highly water-absorptive resin particles comprise a material selected from the group consisting of sodium polyacrylate, lithium polyacrylate, potassium polyacrylate, a vinyl alcohol/acrylamide copolymer, a sodium acrylate/acrylamide copolymer, a cellulose polymer, a starch polymer, an isobutylene/maleic anhydride copolymer, a vinyl alcohol/acrylic acid copolymer, and a polyethylene oxide modified product, dimethyl ammonium polydiallylate, quaternary ammonium polyacrylate.

24. The recording medium according to claim 19 wherein said binder has a thickness of from 1 to 100 μm

25. The recording medium according to claim 19 wherein said binder has a thickness of from 1 to 50 μm

26. The recording medium according to claim 19 wherein said binder layer has a thickness of from 2 to 30 μm.

27. The recording medium according to claim 19 wherein said resin particles are present in the number of from 50 to 1,000 per 1 $mm^2$ of the ink-receiving surface

28. The recording medium according to claim 19 wherein said ink-receiving layer contains the binder in an amount of from 16 to 100 parts by weight based on part by weight of resin particles having an average particle diameter of from 10 to 30 μm.

29. The recording medium according to claim 19 wherein said binder is contained in an amount of from 16 to 80 parts by weight based on 1 part by weight of said resin particles.

30. The recording medium according to claim 19 wherein said binder is contained in an amount of from 16 to 50 parts by weight based on 1 part by weight of said resin particles.

31. The recording medium according to claim 19 wherein said recording medium is light-transmissive.

32. A method for ink-jet recording comprising the step of:

applying ink-droplets on a recording medium having a haze of not more than 50%, which recording medium comprises an ink-receiving layer containing highly water-absorptive resin particles having an average diameter ranging from 1 to 100 μm and a binder comprising a hydrophilic resin, said resin particles protruding to a height of not less than μm from the surface of the binder of said ink-receiving layer and being present in the number of from 50 to 5,000 per 1 $mm^2$ of the ink-receiving surface, and maximum applied ink quantities bein of from 5 to 30 nl per 1 $mm^2$ of the ink-receiving surface, and wherein the ink-receiving layer contains the binder in an amount of from 16 to 100 parts by weight based on 1 part by weight of resin particles.

33. The method according to claim 32, wherein said highly water-absorptive resin particles have a water-absorbing power of from 50 to 1,000 times their own weight.

34. The method according to claim 32, wherein said highly water-absorptive resin particles comprise a material selected from the group consisting of sodium polyacrylate, lithium polyacrylate, potassium polyacrylate, a vinyl alcohol/acrylamide copolymer, a sodium acrylate/acrylamide copolymer, a cellulose polymer, a starch polymer, an isobutylene/maleic anhydride copolymer, a vinyl alcohol/acrylic acid copolymer, and a polyethylene oxide modified product, dimethyl ammonium polydiallylate, quaternary ammonium polyacrylate.

35. The method according to claim 32, wherein said binder has a thickness of from 1 to 100 μm.

36. The method according to claim 32, wherein said binder has a thickness of from 1 to 50 μm.

37. The method according to claim 32, wherein said binder has a thickness of from 2 to 30 μm.

38. The method according to claim 32, wherein said resin particles are present in the number of from 50 to 1,000 per 1 $mm^2$ of the ink-receiving surface.

39. The method according to claim 32, wherein said recording medium is light-transmissive.

40. The method according to claim 32, wherein said binder contains a gelling agent.

41. The method according to claim 40, wherein said gelling agent comprises a condensation product of sorbitol with an aromatic aldehyde.

42. The method according to claim 40, wherein said gelling agent is contained in an amount of from 30% to 70% by weight based on the total weight of said binder.

43. The method according to claim 32, wherein ink-droplets are formed by applying heat energy to inks.

44. A method for color ink-jet recording comprising the step of:

applying ink-droplets of different colors on a recording medium having a haze of not more than 50%, which recording medium comprises an ink-receiving layer containing highly water-absorptive resin particles having an average diameter ranging from 1 to 100 μm and a binder comprising a hydrophilic resin, said resin particles protruding to a height of not less than 1 μm from the surface of the binder of said ink-receiving layer and being present in the number of from 50 to 5,000 per 1 $mm^2$ of the ink-receiving surface, wherein the ink-receiving layer contains the binder in an amount of from 16 to 100 parts by weight based on 1 part by weight of resin particles.

45. The method according to claim 44, wherein said highly water-absorptive resin particles have a water-absorbing power of from 50 to 1,000 times their own weight.

46. The method according to claim 44, wherein said highly water-absorptive resin particles comprise a material selected from the group consisting of sodium polyacrylate, lithium polyacrylate, potassium polyacrylate, a vinyl alcohol/acrylamide copolymer, a sodium acrylate/acrylamide copolymer, a cellulose polymer, a starch polymer, an isobutylene/maleic anhydride copolymer, a vinyl alcohol/acrylic acid copolymer, and a polyethylene oxide modified product, dimethyl ammonium polydiallylate, quaternally ammonium polyacrylate.

47. The method according to claim 44, wherein said binder has a thickness of from 1 to 100 μm.

48. The method according to claim 44, wherein said binder layer has a thickness of from 1 to 50 μm.

49. The method according to claim 44, wherein said binder has a thickness of from 2 to 30 μm.

50. The method according to claim 44, wherein said resin particles are present in the number of from 50 to 1,000 per 1 $mm^2$ of the ink-receiving surface.

51. The method according to claim 44, wherein said recording medium is light-transmissive.

52. The method according to claim 44, wherein said binder contains a gelling agent.

53. The method according to claim 52, wherein said gelling agent comprises a condensation product of sorbitol with an aromatic aldehyde.

54. The method according to claim 52, wherein said gelling agent is contained in an amount of from 30% to 70% by weight based on the total weight of said binder.

55. The method according to claim 44, wherein ink-droplets are formed by applying heat energy to inks.

* * * * *

UNITED STATES PATENT AND TRADEMARK OFFICE

CERTIFICATE OF CORRECTION

PATENT NO. : 5,120,601

DATED : June 9, 1992

INVENTOR(S) : Kotaki et al.

It is certified that error appears in the above-identified patent and that said Letters Patent is hereby corrected as shown below:

COLUMN 1:

Line 44, "simultaneous" should read --simultaneously--; and

Line 48, "that;" should read --that:--.

COLUMN 11:

Line 3, "density;" should read --density:--.

COLUMN 12:

Line 46, "in-receiving" should read --ink-receiving--.

COLUMN 13:

Line 17, "in-receiving" should read --ink-receiving--; and

Line 63, "of" should read --and--.

UNITED STATES PATENT AND TRADEMARK OFFICE

CERTIFICATE OF CORRECTION

PATENT NO. : 5,120,601

DATED : June 9, 1992

INVENTOR(S) : Kotaki et al.

It is certified that error appears in the above-identified patent and that said Letters Patent is hereby corrected as shown below:

COLUMN 14:

Line 36, "layer" should be deleted.

COLUMN 16:

Line 7, "surface, wherein" should read --surface, and maximum applied ink quantities of each color being of from 5 to 10 nl per 1 $mm^2$ of the ink-receiving surface, wherein--;

Line 24, "quaternally" should read --quaternary--; and

Line 29, "layer" should be deleted.

Signed and Sealed this

Seventeenth Day of August, 1993

Bruce Lehman

*Attest:*

BRUCE LEHMAN

*Attesting Officer*

*Commissioner of Patents and Trademarks*